US006548763B2

(12) United States Patent
Kaltenborn et al.

(10) Patent No.: US 6,548,763 B2
(45) Date of Patent: Apr. 15, 2003

(54) CASTING COMPOSITIONS FOR PRODUCING ELECTRICAL INSULATORS

(75) Inventors: Uwe Kaltenborn, Baden-Dattwil (CH); Jens Rocks, Ennetbaden (CH)

(73) Assignee: ABB Research Ltd, Zurich (CH)

( * ) Notice: Subject to any disclaimer, the term of this patent is extended or adjusted under 35 U.S.C. 154(b) by 0 days.

(21) Appl. No.: 09/884,019

(22) Filed: Jun. 20, 2001

(65) Prior Publication Data

US 2002/0007959 A1 Jan. 24, 2002

(30) Foreign Application Priority Data

Jun. 20, 2000 (EP) ..... 00810540

(51) Int. Cl.[7] ..... H01B 17/00

(52) U.S. Cl. ..... 174/137 B; 174/138 C; 174/140 C; 174/176; 427/385.5; 427/386; 427/387; 427/393.4

(58) Field of Search ..... 174/137 B, 138 C, 174/137 A, 140 C, 141 C, 176, 188, 189, 196; 427/385.5, 384, 386, 387, 388.2, 393.4; 523/433, 440

(56) References Cited

U.S. PATENT DOCUMENTS

| | | | | | |
|---|---|---|---|---|---|
| 3,859,314 | A | | 1/1975 | Dukes et al. | |
| 4,076,684 | A | * | 2/1978 | Wohlfarth et al. | 524/861 |
| 4,431,472 | A | * | 2/1984 | Hohl et al. | 156/307.3 |
| 4,537,803 | A | | 8/1985 | Dakin et al. | |
| 4,808,687 | A | * | 2/1989 | Burns | 528/30 |
| 4,935,455 | A | * | 6/1990 | Huy et al. | 522/99 |
| 5,106,943 | A | * | 4/1992 | Yoshimatsu | 528/45 |
| 5,212,218 | A | | 5/1993 | Rinehart | |
| 5,306,747 | A | | 4/1994 | Ito et al. | |
| 5,792,996 | A | * | 8/1998 | Phillips et al. | 174/174 |
| 6,037,392 | A | * | 3/2000 | Tang et al. | 523/201 |

FOREIGN PATENT DOCUMENTS

| | | |
|---|---|---|
| DE | 1570922 | 3/1970 |
| DE | 1590958 | 5/1970 |
| DE | 3126411 A1 | 1/1983 |
| EP | 0297030 A2 | 12/1988 |
| EP | 0356391 A2 | 2/1990 |
| EP | 0462053 A2 | 12/1991 |
| EP | 0506617 A3 | 9/1992 |
| EP | 0536085 A2 | 4/1993 |
| JP | 59136348 | 8/1984 |

* cited by examiner

*Primary Examiner*—Chau N. Nguyen
*Assistant Examiner*—W. David Walkenhorst
(74) *Attorney, Agent, or Firm*—Burns, Doane, Swecker & Mathis, L.L.P.

(57) ABSTRACT

The present invention relates to a liquid or pastelike casting composition based on a polymeric matrix resin or on a mixture of such resins for producing self-healing electrical insulators, the casting composition including in uniform distribution a selected hydrophobicizing compound or a mixture of such compounds in encapsulated form. The casting composition includes a thermosettable casting resin system, based preferably on a thermosettable polycondensate, a thermosettable polyadduct, and/or a hybrid form thereof.

36 Claims, No Drawings

CASTING COMPOSITIONS FOR PRODUCING ELECTRICAL INSULATORS

This application claims priority under 35 U.S.C. §§119 and/or 365 to Appln. No. 00810540.5 filed in Europe on Jun. 20, 2000; the entire content of which is hereby incorporated by reference.

The present invention relates to casting compositions based on polymeric matrix resins for producing self-healing electrical insulators, especially in the form of moldings and coatings in the field of high-voltage insulators for outdoor use, and to the electrical insulators produced in accordance with the invention.

1. Technical Field

High-voltage insulators based on polymeric matrix resins for outdoor use are known per se. For outdoor applications, use is traditionally made of insulators based on glass and ceramic materials. In recent years, polymeric insulants as well have been able to capture a steadily increasing market share. Outdoor insulators are employed in large numbers both in association with high-voltage lines and in the medium-voltage sector, in particular as base insulators. Further fields of use are outdoor power switches, measuring transducers, leadthroughs, overvoltage protectors, and in switchgear construction.

In recent years the use of polymeric materials, such as silicones (RTV, HTV) or ethylene-propylene rubber (EPR, EPDM), and also casting resin systems based on epoxy resins and polyurethanes, has been on the increase. Of the polymeric materials, however, only silicones have achieved general acceptance in the art, silicones being superior to the other polymeric materials on account of their inherent pronounced hydrophobicity and, in particular, the inherent hydrophobicity regain. The high price of silicones, however, is a significant brake on their use in the art.

The polymeric materials mentioned, such as ethylene-propylene rubber or casting resin systems based on epoxy resins and polyurethanes, possess no intrinsic hydrophobicity regain and, moreover, have a significantly lower hydrophobicity. Furthermore, these materials undergo relatively severe degradation due to thermal and oxidative influences, especially UV radiation. There is therefore a need for improved polymeric materials which in terms of their mechanical properties are better than silicones and are suitable for producing electrical insulators which combine an enhanced hydrophobicity with the property of hydrophobicity regain without any marked alteration or weakening in their mechanical properties. Polymeric materials thus improved could be used, for example, to produce inexpensive epoxy resins, and to produce electrical insulators.

Where polymeric materials, such as ethylene-propylene rubber or casting resin systems based on epoxy resins and polyurethanes, for example, are used as high-voltage insulators outdoors and the surface is bedewed, the insulating effect is substantially dependent on the water-repelling effect (hydrophobicity) of this surface. In the case of highly hydrophobic surfaces, as generally occur with silicones, dew deposits are formed as individual droplets separate from one another. Where there is a loss of hydrophobicity, coherent film deposits form on the insulator surface under moist conditions. Markedly increased currents flow through these film deposits, and may possibly lead to instances of sparkover of the insulator, or at any rate may cause accelerated thermal and/or oxidative damage to the polymer matrix. Owing to the polar nature of the epoxy resin matrix, epoxy resin surfaces, and a large number of other thermosetting resin surfaces, lack sufficient water-repelling properties. Therefore, the use of epoxy resins and related materials is substantially restricted to interior applications.

2. Prior Art

The literature appears not to contain any references to the intrinsic modification of casting resin systems in which the casting resin systems are endowed with additional hydrophobicity and the property of hydrophobicity regain and at the same time there is little or no alteration to the mechanical properties.

The U.S. Pat. No. 4,537,803 proposes adding a polymerizable silicone oil to the epoxy resin mixture. U.S. Pat. No. 5,306,747 relates to the addition of a modified silicone oil which is able to react chemically with the resin system. The addition of silicones to the epoxy resin mixture or to other thermosetting systems has the disadvantage, fundamentally, that the physical properties, the reactivity, the flow properties, and the processing properties of the matrix are altered in such a way that, for example, separation phenomena or electrical discharges occur in cavities. U.S. Pat. No. 5,306,747 gives the silicone oil terminal hydroxyphenyl groups and incorporates it chemically into the matrix. The principal disadvantage of this method, as the patent describes, lies in the deterioration in mechanical properties that accompanies increasing chain length of the silicone oil introduced. Additionally, as a result of the direct incorporation of the hydrophobic constituents into the resin matrix, this method does not provide any regain of the hydrophobicity, since the hydrophobicity regain is tied to the diffusion of freely mobile, low molecular mass silicone oligomers.

DESCRIPTION OF THE INVENTION

It has now been found that casting compositions based on polymeric matrix resins for producing self-healing electrical insulators are obtained if encapsulated, selected, water-repelling compounds are added to the polymeric matrix resins prior to their curing. Cured casting compositions based on polymeric matrix resins comprising inventively encapsulated water-repelling compounds exhibit good hydrophobicity and also a pronounced hydrophobicity regain without any marked changes in the mechanical properties. There is no phase separation. It is found in particular that when the capsule material breaks down, which is simultaneous with the thermal and/or oxidative degradation of the cured matrix surface, the encapsulated, water-repelling compound(s) is (are) released, and so diffuse(s) to the direct surface. In doing so, these compounds penetrate the surface and are also able to penetrate into any degraded and/or superimposed external layers that are formed, so that the oxidative and/or thermal degradation of the surface is accompanied in each case by the re-establishment of the hydrophobicity, or self-healing. This process of self-healing continues for as long as the surface subject to erosion comprises the casting composition of the invention. The life expectancy of products produced from the casting compositions of the invention is, accordingly, significantly prolonged. The casting compositions of the invention make it possible to combine excellently the good mechanical properties of inexpensive thermosetting materials with the properties of hydrophobicity and hydrophobicity regain.

The present invention is defined in the claims. The present invention relates in particular to a liquid or pastelike casting composition based on a polymeric matrix resin or a mixture of such resins for producing self-healing electrical insulators, and this casting composition is characterized in that it comprises in uniform distribution a selected hydrophobicizing compound or a mixture of such compounds in encapsulated form.

The casting compositions of the invention are especially suitable for producing moldings and coatings in the field of electrical insulators, especially high-voltage insulators, in particular for outdoor use. It is also possible to use these insulators in interior installations.

In this sense the present invention relates to the use of the casting compositions of the invention to produce moldings and coatings in the field of electrical insulators, especially high-voltage insulators, and, in particular, high-voltage insulators for outdoor use.

The invention further relates to the electrical insulators produced from the casting compositions of the invention.

The invention further relates to a process for preparing the casting compositions of the invention.

According to the invention, suitable casting compositions in liquid or pastelike form include polymeric materials, such as thermosettable casting compositions. Examples of such casting compositions are casting resin systems, especially thermosettable polycondensates, thermosettable polyadducts, and their hybrid forms. As thermosettable casting resins it is possible in accordance with the invention to use the conventional thermosetting molding compounds. Thermosetting polymers are known in large numbers from the literature. Examples of thermosettable polycondensates and polyadducts are curable phenol/formaldehyde polymers, curable urea/formaldehyde polymers, melamine/formaldehyde polymers, curable melamine/phenol/formaldehyde molding compounds, unsaturated polyester resins, DAP resins (polydiallyl phthalates), polyimides, polybenzimidazoles, epoxy resins, and crosslinked polyurethanes (PUs). Preference is given to those having good electrical properties, preferably aromatic and/or cycloaliphatic epoxy resins and/or PU casting compounds.

Epoxy resins and PU resins of this kind, used in the electrical industry, are known per se from the literature and may be used in accordance with the invention. Epoxy resins and PU resins used in the electrical industry are known per se and are described, for example, in I. Quint, Investigations on the influence of poorly conducting external layers on the surface ageing properties of molded cylindrical epoxy resin test specimens loaded with alternating current, dissertation at TH Darmstadt, Darmstadt (1993), or O. Claus, Characterization of the surface state of cylindrical epoxy resin test moldings before and after exposure to aqueous salt-containing external films and 50 Hz alternating voltage, dissertation at TH Darmstadt, Darmstadt (1995). Numerous publications also exist on the electrical Araldit® casting resin systems of Ciba-Geigy AG.

Epoxy resins for electrical applications generally comprise at least one carboxyl-containing polymer, in particular a carboxyl-terminated polyester and/or a carboxyl-containing acrylate and/or methacrylate polymer, and/or a hydroxyl-containing compound or a mixture of such compounds, and also a glycidyl compound or a mixture of glycidyl compounds, and, if desired (but not necessarily), an accelerator for the crosslinking reaction of the glycidyl compound or compounds with the carboxyl-containing polymer and/or the hydroxyl-containing compound, and also further additives customary per se.

Preference is given to crosslinking glycidyl compounds which contain at least two 1,2-epoxide groups in the molecule. It is preferred to use a mixture of polyglycidyl compounds, an example being a mixture of diglycidyl and triglycidyl compounds. Such compounds are known per se and extensively described in the literature. From the known glycidyl compounds it is generally possible to make a selection appropriate for the electrical application envisaged, which for the skilled worker represents an optimization problem.

Suitable glycidyl compounds are described, for example, in EP-A-0 297 030, EP-A-0 356 391, EP-A-0 462 053, EP-A-0 506 617, EP-A-0 536 085, or in U.S. Pat. No. 3,859,314, or in DE-A-31 26 411. They embrace compounds which contain unsubstituted glycidyl groups and/or methyl-substituted glycidyl groups. The glycidyl compounds preferably have a molecular weight of between 200 and 1200, in particular between 200 and 1000, and may be solid or liquid. Their epoxide content is preferably at least three equivalents per kilogram of the compound, preferably at least four equivalents per kilogram, and in particular at least five equivalents per kilogram. Preference is given to glycidyl compounds having glycidyl ether and/or glycidyl ester groups. One glycidyl compound may also contain both kinds of glycidyl groups, an example being glycidyl 4-glycidyloxybenzoate. Preference is given to polyglycidyl esters containing 1–4 glycidyl ester groups, especially diglycidyl esters and/or triglycidyl esters. The preferred diglycidyl esters are preferably derived from aromatic, araliphatic, cycloaliphatic, heterocyclic, heterocyclic-aliphatic or heterocyclic-aromatic dicarboxylic acids having from 6 to 20, in particular from 6 to 12, ring carbon atoms, or from aliphatic dicarboxylic acids having from 2 to 10 carbon atoms. Such compounds are available commercially, for example, under the tradename Araldit® (Ciba SC Ltd). Preference is given, for example, to the epoxy resins that are known per se and are based on polyfunctional aromatic or cycloaliphatic hydroxyl compounds. Known compounds based on aromatic hydroxyl compounds are, for example, the glycidyl ethers of bisphenol A or bisphenol F and also the glycidyl ethers of phenol novolak resins or cresol novolak resins. Examples of cycloaliphatic epoxy resins are bisepoxidized beta-1,2,3,6-tetrahydro-phenylethyl 1',2',3',6'-tetrahydrobenzoate, and bis-glycidyl hexahydro-o-phthalate. Aliphatic epoxy resins as well, such as 1,4-butanediol diglycidyl ether, for example, are suitable for use in accordance with the invention.

It is preferred to employ casting compositions comprising at least one filler. Such fillers are preferably quartz flour, alumina and/or dolomites in a variety of ground forms known per se. The fillers have preferably been silanized in order to ensure optimum chemical attachment of the particles in the resin matrix.

Compounds with a hydrophobicizing action are preferably flowable fluorinated and/or chlorinated hydrocarbons which contain —$CH_2$ units and/or —CHF units, —$CF_2$ units, —$CF_3$ units, —CHCl units, —$C(Cl)_2$ units and/or —$C(Cl)_3$ units, or cyclic, linear or branched flowable organopolysiloxanes. These preferably have a viscosity in the range from about 50 cSt to 10,000 cSt, preferably in the range from 100 cSt to 10,000 cSt, and preferably in the range from 500 cSt to 3000 cSt, measured in accordance with DIN 53 019 at 20° C.

The organopolysiloxane preferably comprises a compound, or mixture of compounds, of the general formula (I):

(I)

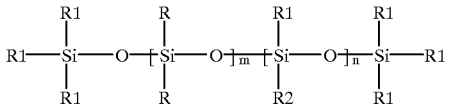

in which

R independently at each occurrence is an unsubstituted or chlorinated and/or fluorinated alkyl radical having from 1 to 8 carbon atoms, ($C_1$–$C_4$ alkyl)aryl or aryl; preferably an unsubstituted or fluorinated alkyl radical having from 1 to 4 carbon atoms or phenyl; preferably 3,3,3-trifluoropropyl, monofluoromethyl, difluoromethyl or alkyl having 1–4 carbon atoms; preferably methyl;

$R_1$ independently at each occurrence has one of the definitions of R or $R_2$, it being possible for two terminal substituents $R_1$ attached to different Si atoms, and taken together, to be an oxygen atom (=cyclic compound);

$R_2$ has one of the definitions of R, or is hydrogen or a radical $—(A)_r—CH{=}CH_2$;

A is a radical $—C_sH_{2s}—$, preferably $—(CH_2)_s—$, where s is an integer from 1 to 6, preferably 1;

r is zero or one;

m is on average from zero to 5000, preferably from 20 to 5000, preferably from 50 to 1500;

n is on average from zero to 100, preferably from 2 to 100, preferably from 2 to 20;

the sum of [m+n] for noncyclic compounds being at least 20, preferably at least 50, and the sequence of the groups —[Si(R)(R)O]— and —[Si($R_1$)($R_2$)O]— in the molecule being arbitrary. The sum of [m+n] for noncyclic compounds is preferably on average in the range from 20 to 5000, preferably in the range from 50 to 1500.

Preferably, $R_2$ has one of the definitions of R, and R is preferably methyl or phenyl, it being possible for both methyl and phenyl to be present in the molecule. The ratio of methyl to phenyl is determined by the flowability of the compound or mixture of compounds. Preferably, R is methyl. The compound of the formula (I) generally constitutes a mixture of compounds of the formula (I), as is known to the skilled worker.

Where the compound of the formula (I) is a cyclic compound, it is composed of —[Si(R)(R)O]— and/or —[Si$R_1$($R_2$)O]— units which form a ring with preferably from 4 to 12 such units. Of the cyclic siloxanes, however, preference is given to the cyclic oligomeric polysiloxanes having from 4 to 8 siloxy units, especially to polydimethylsiloxanes having from 4 to 8 siloxy units. However, these cyclic compounds may also comprise, for example, organohydropolysiloxanes, containing, for example, only —[SiH($R_2$)O]— units, or, correspondingly, may constitute organovinylpoly-siloxanes.

In one specific embodiment of the present invention, $R_2$ is both hydrogen and $—A—CH{=}CH_2$, $R_2$ per molecule being only either hydrogen or $—A—CH{=}CH_2$. In this context, a compound in which $R_2$ is hydrogen and the other compound, in which $R_2$ is $—A—CH{=}CH_2$, are encapsulated separately and these two encapsulated compounds are added at least in equimolar amounts to the casting composition of the invention. Preferably, however, the compound containing Si—H groups is used in a molar excess of from 20 to 50% based on the component comprising the radical $—A—CH{=}CH_2$. When the capsule shells break down due to thermal and/or oxidative degradation, the two components flow into one another and together undergo an addition reaction which reinforces the hydrophobicity and hydrophobicity return through the formation of a relatively stable layer. In order to permit the addition-crosslinking reaction, at least one of the two encapsulated components comprises a complex compound or a mixture of such complex compounds from the group of the rhodium metals, nickel metals, palladium metals and/or platinum metals, as known as catalytically active compounds for addition reactions between SiH bonds and alkenyl radicals. Preference is given to Pt(0) complexes with alkenylsiloxane ligands or Rh catalysts in catalytic amounts of preferably from 1 to 100 ppm platinum. Such compounds are described extensively in the literature and are known to the skilled worker. For this embodiment, the two terminal silyloxy groups of the component containing the radical $—A—CH{=}CH_2$ are, independently of one another, preferably dimethylvinylsiloxy, with n being preferably zero. The individual components have a viscosity which is preferably in the range from about 10 cSt to 10,000 cSt, preferably in the range from 100 cSt to 10,000 cSt, and preferably in the range from 500 cSt to 3000 cSt, measured in accordance with DIN 53 019 at 20° C. Depending on preparation, the compounds of the formula (I) may also contain up to 10 mole percent, calculated on the basis of the Si atoms present, of both alkoxy groups and OH groups. Such compounds are situated within the present invention.

For the encapsulation of the hydrophobicizing compound or compounds it is preferred to use the same polymeric compound or compositions which are used as the polymeric matrix resin. This has the advantage that the encapsulation, i.e., the wall material, is degraded by thermal and/or oxidative influences at the same rate as the surface of the insulator itself. Consequently, the encapsulation breaks down at the right time in each case and releases the encapsulated compound at the ideal point in time. The encapsulation material is preferably chosen so that it is thermally and/or oxidatively degraded at the same rate or faster than the matrix material. In any case, the encapsulation material need not be the same as the matrix material.

Suitable encapsulation materials comprise the same compounds listed above as matrix materials. Suitable compounds are synthetic rubbers and the abovementioned thermosettable compositions, which in each case independently of one another may generally be introduced into all matrix systems. As encapsulation material it is preferred to use ethylene-propylene rubber (EPR), ethylene-propylene-diene terpolymers (EPDM) or styrene-butadiene copolymers (PBR) and related compounds, if the encapsulated compounds are to be introduced into synthetic rubbers. Used with advantage as encapsulation material are thermosettable polycondensates, thermosettable polyadducts, and their hybrid forms, when the encapsulated compounds are to be introduced into a thermosettable casting resin system. Preferred encapsulation materials are melamine/formaldehyde resins, curable melamine/phenol/formaldehyde molding compounds, epoxy resins, and crosslinked polyurethanes.

It is preferred to use an encapsulation material which behaves in the same way as the matrix material. Using, for example, a melamine/formaldehyde resin as encapsulation material in an epoxy resin matrix, the curing of the matrix is accompanied by the incorporation and fixing of said material in said matrix, which ensures uniform distribution of the hydrophobicizing compound over a long period and has a positive impact on the mechanical properties of the insulator produced.

Methods of encapsulating liquid and pastelike compounds are known and are described, for example, in Advances in Polymer Science, Part 136, Microencapsulation, Microgels, Iniferters, Springer Verlag, 1998 or in ACS Symposium Series, Part 590, Encapsulation and controlled release of Food Ingredients. The general procedure is to finely disperse the compound to be encapsulated (core material), a silicone oil, for example, in the encapsulation material (wall material), a melamine/formaldehyde resin, for example, in a wall material:core material ratio of, for example, from 10:1 to 2:1, preferably from 6:1 to 3:1, in particular about 4:1, and then to cure the resulting dispersion, at least in part, at a high temperature, by means of spraying, for example. Appropriate method techniques are known per se to the skilled worker.

The encapsulated material or the particles containing the liquid or pastelike compound(s), and/or encapsulated compound(s), preferably has or have a particle diameter of preferably 2 μm–1000 μm, preferably 5 μm–500 μm, and preferably 5 μm–100 μm. The casting composition of the invention comprises preferably about 0.1% by weight–10% by weight hydrophobicizing compound, preferably 0.25% by weight–5% by weight hydrophobicizing compound, preferably about 0.25% by weight–3% by weight, based on the overall weight of the casting composition.

The casting compositions of the invention are produced by stirring the encapsulated liquid or pastelike compound or an encapsulated mixture of such compounds, i.e., the encapsulated material, into the matrix material, with or without the use of a surface-active compound and/or an emulsifier. In order to prevent floating, it is advantageous to add highly disperse (pyrogenic) silica (Aerosil) or a similarly effective compound to the matrix.

In this context, the present invention relates to a process for preparing liquid or pastelike casting compositions based on polymeric matrix resins for producing self-healing electrical insulators, which is characterized in that (a) a selected hydrophobicizing compound or a mixture of such compounds is encapsulated in a suitable encapsulation material and is cured at least in part, and (b) the encapsulated material is dispersed in uniform distribution into a suitable liquid or pastelike polymeric matrix resin.

The "selected hydrophobicizing compound or a mixture of such compounds", the "encapsulation material", the "suitable liquid or pastelike polymeric matrix resin", the further auxiliaries employed in this preparation process, and also the preferred conditions have already been described above.

The casting compositions of the invention are used in particular to produce high-voltage insulation for outdoor use, in particular to produce outdoor insulators associated with high-voltage lines, as long-rod, composite and cap-type insulators, and also for base insulators in the medium-voltage sector. The casting compositions of the invention may also find application in the production of insulators associated with outdoor power switches, measuring transducers, leadthroughs and overvoltage protectors, in switchgear construction, in power switches, dry-type transformers and electrical machines. Furthermore, the casting compositions of the invention may also be used as coating materials for transistors and other semiconductor elements and, very generally, for impregnating electrical components. The casting composition of the invention may likewise be used as corrosion protection for metallic components, e.g., for bridges and industrial installations, in which case, for example, the gloss of the coat does not disappear even on aging.

The molding is produced or cast in one step or in two or more steps. For instance, it is possible first to cast a core whose material does not contain any encapsulated adjuvant. Then, in a second casting step, the finished form is produced by coating the core with the casting material of the invention. The core may consist of any appropriate material, including for example a fiber-reinforced plastic. Preferably used as the core is a material which is compatible with the casting material of the invention and which in particular is able to enter into a chemical bond therewith. This is the case, for example, when the core comprises an unmodified casting resin and the coating comprises an inventively modified casting resin. A further possibility is to cast the casting material of the invention onto a core, and for the core not to enter into any chemical bond with the polymer matrix of the casting material but for a sufficiently strong mechanical connection to be formed between the core and the cast-on part owing to the shrinkage pressure of the casting material. The following examples illustrate the invention.

EXAMPLE 1 a) Encapsulation of a silicone oil:

15 grams of a mixture of a linear dimethylsiloxane (Baysilone M-1000 from GE-Bayer Silikones, D-Leverkusen) having a viscosity of 1000 cSt at 20° C. are dispersed in 90 grams of a liquid uncured melamine-formaldehyde resin starting mixture until the silicone oil has reached an average droplet size in the range of 10 μm–50 μm. The dispersion is subsequently sprayed finely through a nozzle and partially cured at a temperature of 150° C. to give a free-flowing powder having an average particle size in the range of 5 μm–100 μm.

b) Preparation of the casting composition:

10.0 grams of the pulverulent encapsulated silicone oil obtained as per a) are mixed into 100 parts of the liquid epoxy resin formulation EP 1020-6 QMEST (CIBA SC AG, Basle) until distribution is uniform. The epoxy resin formulation contains 62% by weight silanized quartz flour. The casting resin is evacuated in a vessel and is cast under vacuum into a casting mold, which is at a temperature of 80° C. Following a gelling time of 4 hours at 80° C., the test specimens are removed from the casting mold and after-cured at 140° C. for 10 hours. The result is a plate, 4 mm thick, which is processed to give test specimens.

c) Test method for measuring the hydrophobicity, the hydrophobicity retention and the hydrophobicity return, and also comparative results between the test specimens produced (i) from cured casting resin with the addition of the encapsulated silicone oil and (ii) from cured casting resin without the addition of the encapsulated silicone oil.

To test the electrical properties of the (i) test specimens produced from the casting composition of the invention with the (ii) test specimens produced from the conventional casting composition, the two test specimens are subjected to an electrical corona discharge for a period of at least 20 minutes. During this period the surface hydrophobicity is occasionally reduced or destroyed completely, after which a recovery of hydrophobicity sets in. The hydrophobicity is measured in a manner known per se using the dynamic advance angle with water in degrees (°). The greater the advance angle, the higher the hydrophobicity. The measured dynamic advancing angles for cured casting compositions or test specimens of the invention, and the comparison values for the comparable conventional test specimens, are listed in table 1. The measured mechanical properties of the two test specimens are substantially comparable in their magnitude and in any case are well above the requisite service values.

TABLE 1

| | Dynamic advancing angle (water, in °) Test specimen as per example 1 (b) | Dynamic advancing angle (water, in °) Test specimen without the addition of encapsulated silicone oil |
|---|---|---|
| Base hydrophobicity (without corona discharge) | 95 | 115 |
| Hydrophobicity directly after corona discharge | zero | 50 |
| Hydrophobicity after 20 h | 40 | 80 |
| Hydrophobicity after 100 h | 50 | 90 |
| Hydrophobicity after 200 h | 50 | 100 |
| Hydrophobicity after 300 h | 50 | 100 |
| Hydrophobicity after 400 h | 50 | 110 |
| Hydrophobicity after 500 h | 50 | 110 |

If the silicone oil in the example is replaced by a fluorinated linear dimethylsiloxane, the results obtained are comparable.

What is claimed is:

1. A liquid or paste-like casting composition suitable for the production of a self-healing electrical insulator comprising:

a polymeric matrix resin or a mixture of said resins comprising a thermosettable casting resin system selected from thermosettable polycondensates, thermosettable polyadducts, hybrid forms and mixtures thereof, wherein (i) in uniform distribution is present a hydrophobicizing compound or a mixture of said compounds selected from flowable fluorinated or chlorinated hydrocarbons which contain —$CH_2$-units, —CHF-units, —$CF_2$-units, —$CF_3$-units, —CHCl-units, —$C(Cl)_2$-units, —$C(Cl)_3$-units, or mixtures thereof, or a cyclic, linear or branched flowable organopolysiloxane, and wherein (ii) said hydrophobicizing compound or said mixture of said compounds is present in encapsulated form.

2. The casting composition as claimed in claim 1, wherein the matrix resin is selected from the group of curable phenol/formaldehyde polymers, urea/formaldehyde polymers, melamine/formaldehyde polymers, melamine/phenol/formaldehyde molding compounds, unsaturated polyester resins, DAP resins, polyimides, polybenzimidazoles, epoxy resins and crosslinked polyurethanes (PUs).

3. The casting composition as claimed in claim 2, wherein the matrix resin is an aromatic or cycloaliphatic epoxy resin or a mixture thereof, or a PU casting compound or a mixture thereof.

4. The casting composition as claimed in claim 1, wherein the matrix resin comprises an aromatic, a cycloaliphatic epoxy resin or a mixture thereof and at least one crosslinking glycidyl compound containing at least two 1,2-epoxide groups in the molecule.

5. The casting composition as claimed in claim 4, wherein the epoxy resin comprises a mixture of diglycidyl and triglycidyl compounds.

6. The casting composition as claimed in claim 4, wherein the glycidyl compound has a molecular weight of between 200 and 1200 and an epoxide content is at least three equivalents per kilogram of the compound.

7. The casting composition as claimed in claim 6, wherein the glycidyl compound has a molecular weight of between 200 and 1000, and the epoxide content is at least four equivalents per kilogram.

8. The casting composition as claimed in claim 4, wherein the epoxide content is at least five equivalents per kilogram.

9. The casting composition as claimed in claim 1, wherein the casting composition comprises at least one filler.

10. The casting composition as claimed in claim 9, wherein said at least one filler optionally is silanized and is selected from quartz flour, alumina, dolomite or a mixture thereof.

11. The casting composition as claimed in claim 1, wherein the hydrophobicizing compound has a viscosity in the range from 50 cSt to 10,000 cSt, measured in accordance with DIN 53 019 at 20° C.

12. The casting composition as claimed in claim 11, wherein the hydrophobicizing compound has a viscosity in the range from 100 cSt to 10,000 cSt, measured in accordance with DIN 53 019 at 20° C.

13. The casting composition as claimed in claim 12, wherein the hydrophobicizing compound has a viscosity in the range from 500 cSt to 3000 cSt, measured in accordance with DIN 53 019 at 20° C.

14. The casting composition as claimed in claim 1, wherein the hydrophobicizing compound comprises a compound, or mixture of compounds, of the general formula (I):

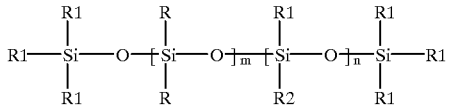

(I)

wherein R independently at each occurrence is an unsubstituted, a chlorinated or fluorinated, or a chlorinated and fluorinated alkyl radical having from 1 to 8 carbon atoms, ($C_1$–$C_4$-alkyl)aryl, or aryl, $R_1$ independently at each occurrence has one of the definitions of R or $R_2$, it being possible for two terminal substituents $R_1$ attached to different Si atoms, and taken together, to be an oxygen atom (=cyclic compound), $R_2$ has one of the definitions of R, or is hydrogen or a radical —$(A)_r$—CH=$CH_2$, A is a radical —$C_sH_{2s}$—, where s is an integer from 1 to 6, r is zero or one;

m is on average from zero to 5000, n is on average from zero to 100, a sum of [m+n] for non-cyclic compounds being at least 20, and a sequence of the groups —[Si(R)(R)O]— and —[Si($R_1$)($R_2$)O]— in the compound being arbitrary.

15. The casting composition as claimed in claim 14, wherein in the compound of the formula (I)

R independently at each occurrence is an unsubstituted or fluorinated alkyl radical having from 1 to 4 carbon atoms or phenyl, A is a radical —($CH_2$)—, m is on average from 20 to 5000, n is on average from 2 to 100, the sum of [m+n] for non-cyclic compounds being on average in the range from 20 to 5000, and the sequence of the groups —[Si(R)(R)O]— and —[Si($R_1$)($R_2$)O]— in the compound being arbitrary.

16. The casting composition as claimed in claim 15, wherein in the compound of the formula (I)

R independently at each occurrence is 3,3,3-trifluoropropyl, monofluoromethyl, difluoromethyl, or an alkyl having 1–4 carbon atoms, A is a radical —($CH_2$)—, m is on average from 50 to 1500, n is on average from 2 to 20, the sum of [m+n] for non-cyclic compounds being on average in the range from 50 to 1500, and the sequence of the groups —[Si(R)(R)O]— and —[Si($R_1$)($R_2$)O]— in the compound being arbitrary.

17. The casting composition as claimed in claim 14, wherein in the compound of the formula (I), R independently at each occurrence is methyl.

18. The casting composition as claimed in claim 14, wherein the compound of the formula (I) comprises a cyclic compound which is composed of —[Si(R)(R)O]-units, —[Si($R_1$)($R_2$)O]-units, or —[Si(R)(R)O]-units and —[Si($R_1$)($R_2$)O]-units and forms a ring with from 4 to 12 such units.

19. The casting composition as claimed in claim 18, wherein the compound of the formula (I) comprises a cyclic polydimethylsiloxane, a cyclic organohydropolysiloxane, or a cyclic organovinylpolysiloxane having from 4 to 8 siloxy units.

20. The casting composition as claimed in claim 14, wherein in the compound of the formula (I) $R_2$ is both hydrogen and —A—CH=$CH_2$, and $R_2$ per molecule being only either hydrogen or —A—CH=$CH_2$, and each of these two separately encapsulated compounds are present in the casting composition at least in equimolar amounts together with at least one complex compound or a mixture of complex compounds selected from rhodium metals, nickel metals, palladium metals and platinum metals.

21. The casting composition as claimed in claim 1, wherein the hydrophobicizing compound is encapsulated with a thermosettable casting resin system, the thermosettable casting resin system selected from thermosettable polycondensates, thermosettable polyadducts, hybrid forms and mixtures thereof.

22. The casting composition as claimed in claim 21, wherein the hydrophobicizing compound is encapsulated with a melamine/formaldehyde resin, a curable melamine/phenol/formaldehyde molding compound, an epoxy resin, a crosslinked polyurethane, or a mixture thereof.

23. The casting composition as claimed in claim 1, wherein the ratio of wall material to the compound to be encapsulated is in the range from 10:1 to 2:1.

24. The casting composition as claimed in claim 23, wherein the ratio of wall material to the compound to be encapsulated is in the range from 6:1 to 3:1.

25. The casting composition as claimed in claim 24, wherein the ratio of wall material to the compound to be encapsulated is in the range from 4:1.

26. The casting composition as claimed in claim 1, wherein the encapsulated material or the particles which comprise encapsulated compounds have a particle diameter of 2 $\mu$m to 1000 $\mu$m.

27. The casting composition as claimed in claim 26, wherein the encapsulated material or the particles which comprise encapsulated compounds have a particle diameter of 5 $\mu$m to 500 $\mu$m.

28. The casting composition as claimed in claim 27, wherein the encapsulated material or the particles which comprise encapsulated compounds have a particle diameter of 5 $\mu$m to 100 $\mu$m.

29. The casting composition as claimed in claim 1, wherein the casting compound contains from 0.1% by weight to 10% by weight of the hydrophobicizing compound.

30. The casting composition as claimed in claim 29, wherein the casting compound contains from 0.25% by weight to 5% by weight of hydrophobicizing compound.

31. The casting composition as claimed in claim 30, wherein the casting compound contains from 0.25% by weight to 3% by weight of hydrophobicizing compound.

32. A process for preparing a liquid or paste-like casting composition according to claim 1, the process comprising the steps of:

(a) providing a selected hydrophobicizing compound or a mixture of such compounds selected from flowable fluorinated or chlorinated hydrocarbons which contain—$CH_2$-units, —CHF-units, —$CF_2$-units, —CHCl-units, —$C(Cl)_2$-units, —$C(Cl)_3$-units, or mixtures thereof, or a cyclic, a linear or a branched flowable organopolysiloxane;

(b) encapsulating said hydrophobicizing compound or said mixture of such compounds with a thermosettable casting resin system selected from thermosettable polycondensates, thermosettable polyadducts, hybrid forms and mixtures thereof and subsequently curing the encapsulated material at least in part; and (c) dispersing said encapsulated material uniformly into the polymeric matrix resin.

33. A process for preparing a self-healing electrical insulator comprising the step of (d) applying the liquid or paste-like casting composition as prepared in claim 32 to the shape of an electrical insulator and curing the thus obtained liquid or paste-like shape of the casting composition.

34. A component treated by the process as set forth in claim 33.

35. The use of a casting composition as claimed in claim 1 to produce high-voltage insulation for outdoor use, a measuring transducer, a leadthrough, an overvoltage protector, in switchgear construction, in power switches, dry-type transformers, and electrical machines, as a coating material for transistors or a semiconductor element, to impregnate an electrical components, or as corrosion protection for a metallic component.

36. The use of a casting composition as claimed in claim 35, wherein outdoor use includes an outdoor insulator associated with high-voltage lines, a long-rod, composite or cap-type insulator, a base insulator in a medium-voltage sector, an insulator associated with outdoor power switches.

* * * * *